US006533389B2

(12) United States Patent
Hiyane et al.

(10) Patent No.: US 6,533,389 B2
(45) **Date of Patent: *Mar. 18, 2003**

(54) INK JET PRINTER IN WHICH REACTION FORCE IS CANCELED

(75) Inventors: Masao Hiyane, Kawaski (JP); Toshio Fukushima, Hyogo (JP); Kazuki Ogawa, Kawasaki (JP); Yasuo Numata, Kawasaki (JP); Yuji Yoshida, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/801,670

(22) Filed: Mar. 9, 2001

(65) Prior Publication Data

US 2002/0154188 A1 Oct. 24, 2002

Related U.S. Application Data

(62) Division of application No. 08/501,928, filed on Jul. 13, 1995.

(30) Foreign Application Priority Data

| | | |
|---|---|---|
| Jul. 14, 1994 | (JP) | 06-161762 |
| Feb. 7, 1995 | (JP) | 07-019068 |
| Jul. 3, 1995 | (JP) | 07-167402 |

(51) Int. Cl.[7] ..... B41J 23/00
(52) U.S. Cl. ..... 347/37
(58) Field of Search ..... 347/37, 39, 42, 347/38; 400/322; 310/12

(56) References Cited

U.S. PATENT DOCUMENTS

| | | | |
|---|---|---|---|
| 4,314,282 A | 2/1982 | Fischbeck et al. | |
| 4,322,063 A | 3/1982 | Fischbeck et al. | |
| 4,428,693 A | 1/1984 | Bovio et al. | |

(List continued on next page.)

FOREIGN PATENT DOCUMENTS

| | | | |
|---|---|---|---|
| DE | 3133-992 A1 | | 3/1982 |
| JP | 48-40330 | | 6/1973 |
| JP | 55-087562 | * | 7/1980 |

(List continued on next page.)

OTHER PUBLICATIONS

IBM Technical Disclosure Bulletin, vol. 21, No. 1, Jun. 1978, Booth, J.R.; Lebda, K.D. and McKinney, J.D.

*Primary Examiner*—Hezron Williams
*Assistant Examiner*—Charlene Dickens
(74) *Attorney, Agent, or Firm*—Arent Fox Kintner Plotkin & Kahn, PLLC

(57) ABSTRACT

The present invention relates to an ink jet printer in which drops of ink are jetted out onto a surface of a recording medium so as to record an image. The present invention is to obtain an economical ink jet printer in which a reaction force generated in the reciprocal motion of the ink jet head is simply canceled, and the ink jet printer is small and light, and less vibration is caused in the printer, and further it is possible to drive the printer with a small amount of drive energy. The ink jet printer includes: a recording medium conveyance device for conveying a recording medium in the subsidiary direction; a plurality of ink jet heads in which a plurality of nozzles for jetting drops of ink to a surface of the recording medium are disposed, the ink jet heads being capable of moving in the primary scanning direction substantially perpendicular to the subsidiary scanning direction, the ink jet heads being arranged in the printer main body being aligned in the subsidiary scanning direction; and a head reciprocation drive device for reciprocating the ink jet heads in the primary scanning direction at phases different from each other.

1 Claim, 12 Drawing Sheets

U.S. PATENT DOCUMENTS

| | | | | | |
|---|---|---|---|---|---|
| 4,439,779 | A | | 3/1984 | Bovio et al. | |
| 4,456,934 | A | | 6/1984 | Wedman et al. | |
| 4,513,661 | A | | 4/1985 | Melissa et al. | |
| 4,573,094 | A | | 2/1986 | Gibeau et al. | |
| 4,839,741 | A | | 6/1989 | Wilson | |
| 5,677,719 | A | | 10/1997 | Granzow | |
| 6,231,158 | B1 | * | 5/2001 | Hiyane et al. | 347/37 |

FOREIGN PATENT DOCUMENTS

| | | | | | |
|---|---|---|---|---|---|
| JP | 56-161774 | | 12/1981 | | |
| JP | 56-169081 | | 12/1981 | | |
| JP | 58-213308 | | 12/1983 | | |
| JP | 59-83671 | | 5/1984 | | |
| JP | 60-30354 | * | 2/1985 | | |
| JP | 60-57575 | | 4/1985 | | |
| JP | 60-62945 | * | 5/1985 | | |
| JP | 1-221251 | | 9/1989 | | 347/37 |
| JP | 3-213350 | * | 9/1991 | | |
| JP | 5-138876 | | 6/1993 | | 347/39 |
| JP | 5-138971 | | 6/1993 | | |
| JP | 5177827 | * | 7/1993 | | |

* cited by examiner

INK JET PRINTER IN WHICH REACTION FORCE IS CANCELED

This is a Division of application Ser. No. 08/501,928 filed Jul. 13, 1995. The disclosure of the prior application is hereby incorporated by reference herein in its entirety.

BACKGROUND OF THE INVENTION

1. Field of the Invention

The present invention relates to an ink jet printer in which drops of ink are jetted out onto a surface of a recording medium so as to record an image, and also relates to a linear actuator to be applied to this ink jet printer.

2. Description of the Related Art

An ink jet printer is characterized in that its weight is light and its structure is simple. In general, an ink jet head in which a large number of ink jet mechanisms are arranged close to each other in a small region is scanned in the lateral direction of a recording sheet, that is, in the primary scanning direction. Since a relatively heavy ink jet head is suddenly reversed on both sides in this system, a large amount of driving energy is required. The required energy is supplied by an electric motor, and it is not easy to accumulate the supplied energy so as to utilize it when the movement of the ink jet head is reversed. Since a jet of ink is stopped during the reversal of the ink jet head, time is wasted. It is preferable to complete the reversal of the ink jet head in as short a time as possible. Therefore, it is necessary to suddenly accelerate the ink jet head. Accordingly, the apparatus is given a reaction force by the sudden acceleration. Due the angular moment caused by the reaction force, vibration tends to be generated.

Conventionally, the following measures are taken to solve the above problems. For example, according to Japanese Examined Patent Publication No. 51-48743, an ink jet head supported by a spring is moved by an electromagnetic force so that scanning can be conducted on a surface of a recording sheet by the ink jet head. According to Japanese Examined Patent Publication No. 63-54552, in order to cancel an influence of the reaction force, a counter weight is moved in a direction opposite to the moving direction of the ink jet head. However, according to Japanese Examined Patent Publication No. 51-48743, when a single ink jet head is moved, a reaction force is given to a base portion of the support spring. Therefore, it is necessary to provide a base having a sufficiently high rigidity and mass. As a result, the apparatus becomes heavy and large. According to Japanese Examined Patent Publication No. 63-54552, the apparatus is composed in such a manner that a simple counterweight is guided by a slide shaft. Therefore, the mechanisms of a guide bearing and a drive cam become complicated, and energy is wasted to drive an additional mass.

According to Japanese Examined Patent Publication No. 2-31543, an optical sensor and an ink jet head arranged in line with each other are supported by a spring, and a plunger magnet is used as a drive source. According to Japanese Unexamined Patent Publication No. 5-138971, an ink jet head is supported by an elastic body, and back and forth movement is generated in the ink jet head by an urging mechanism directed to the center of amplitude.

In the cases of Japanese Examined Patent Publication No. 2-31543 and Japanese Unexamined Patent Publication No. 5-138971, a reaction force exerted by the moving body is received by a base. Therefore, the vibration generating force is not reduced, so that a base having a sufficiently high rigidity and mass is required. As a result, the apparatus becomes heavy.

In order to increase the printing speed of this type ink jet printer, it is necessary to use a printing head provided with a large number of nozzles in the width direction of the recording sheet and to move the printing head back and forth in a direction perpendicular to the recording sheet feed direction.

An ideal reciprocating motion for this type of printer, if slotted with time on the horizogal axis and distance on the vertical axis, forms a saw-tooth-wave. In other words, it is preferable to control an actuator in such a manner that the ink jet head advances at a constant speed and returns at an infinite speed or a very high speed.

However, in this case, a very high acceleration is required at the beginning of the motion. Especially, at the beginning of the returning motion, a very high acceleration is required. Accordingly, even when either a movable coil type or a stationary coil type linear actuator is used, a strong force is applied to the base, causing vibration in the base. The most natural reciprocal movement is a sine wave movement provided when a movable coil or stationary coil is given a sine wave current, or sine wave vibration provided by the combination of a spring and mass. However, even in this case, a high acceleration is generated at the turning point of the reciprocal motion, and a strong force is given to the base in the same manner as described above. When the strong force is given to the base like this, the following problems may be encountered. When the base is light or the rigidity is not sufficiently high, the base itself will vibrate, and in the worst case, the motion of the printing head will be hindered by the vibration of the base, and it is impossible to attain a sufficiently high printing accuracy.

SUMMARY OF THE INVENTION

An object of the present invention is to provide an economical ink jet printer in which a reaction force generated in the reciprocal motion of the ink jet head is simply canceled, and the ink jet printer is small and light, and less vibration is caused in the printer, and further it is possible to drive the printer with a small amount of drive energy.

The present invention has been proposed to solve the above problems of the conventional ink jet printers. Another object of the present invention is to provide an actuator for driving a printing head and other units which must be driven back and forth, characterized in that less vibration is given to the base, and the structure is simple and further there is no possibility of breaking wires.

In order to accomplish the above objects, as illustrated in FIG. 1 showing an embodiment of the present invention, an ink jet printer of the present invention comprises: a recording medium conveyance means for conveying a recording medium in a subsidiary scanning direction; a plurality of ink jet heads in which a plurality of nozzles for jetting drops of ink onto a surface of the recording medium are arranged, the plurality of ink jet heads being capable of moving in a primary scanning direction substantially perpendicular to the subsidiary scanning direction, the plurality of ink jet heads being arranged in the subsidiary scanning direction; and an ink jet head reciprocal means for reciprocating each ink jet head in the primary scanning direction at a different phase. It is preferable that at least a pair of ink jet heads be provided and driven by the ink jet head reciprocal means with phases directly opposite to each other.

When the plurality of ink jet heads arranged in line in the subsidiary scanning direction are reciprocated in the primary scanning direction at the different phases, it is possible to cancel the reaction force generated by the reciprocal motion of each ink jet head. In this case, when at least one pair of ink jet heads is provided and the pair of ink jet heads is driven with directly opposite phases, the reaction forces generated by the reciprocal motions of both ink jet heads can be completely canceled.

A linear actuator for driving the heads of the ink jet printer comprises: a stationary coil; and two permanent magnets, wherein opposite magnetic poles are opposed to each other on both sides of the stationary coil, so that a magnetic field is formed in a direction perpendicular to the axial direction of the coil, and at least one of the permanent magnets is movable. When a current is allowed to flow in the stationary coil, forces generated by the current and magnetic fields formed by the permanent magnets move the permanent magnets in the opposite direction to each other. Consequently, a force transmitted to the base from one of the permanent magnets is canceled by a force F transmitted to the base from the other permanent magnet. Therefore, the occurrence of vibration of the base can be prevented.

DESCRIPTION OF THE PREFERRED EMBODIMENTS

With reference to the accompanying drawings, embodiments of the present invention will be explained in detail as follow.

Figure 1:
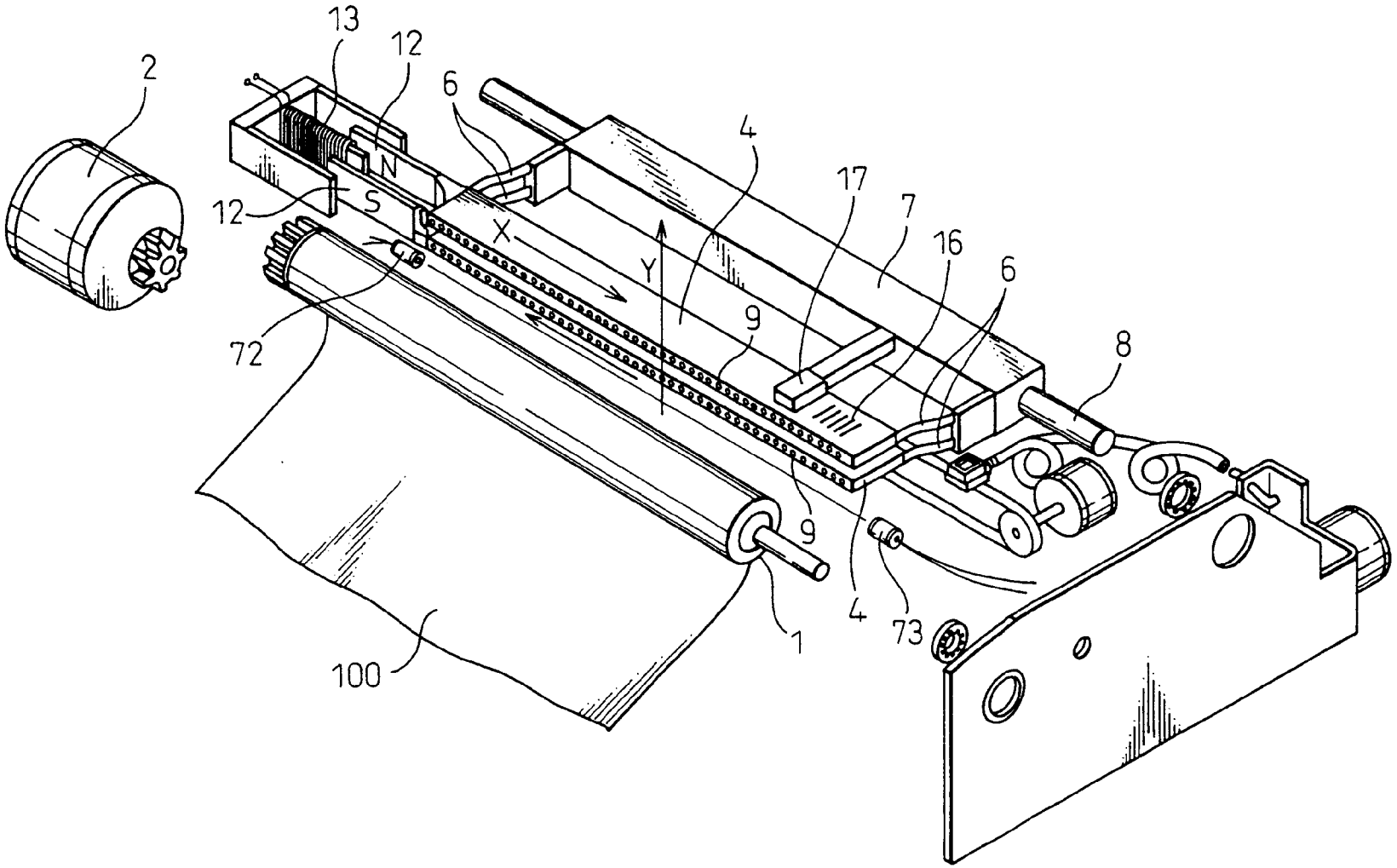
FIG. 1 is a perspective view of the ink jet printer of the first embodiment of the present invention.
Figure 2:
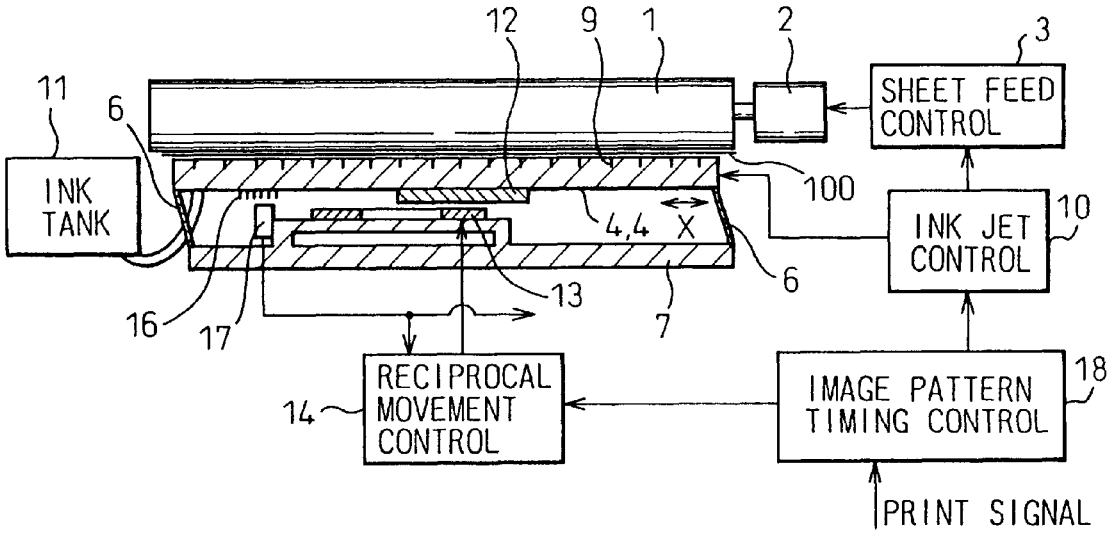
FIG. 2 is a plan view of the printer of the first embodiment.

FIGS. 1 and 2 are views showing an ink jet printer of the first embodiment of the present invention.

In the drawings, the platen roller 1 conveys a recording sheet 100 under the condition that the recording sheet 100 is wound round a portion of the outer circumferential surface of the platen roller 1. The platen roller 1 is supported by a frame, which is a stationary member not shown in the drawings, so that the platen roller 1 can be rotated around the axis. The platen roller 1 is driven by a sheet feed motor 2. Rotation of the sheet feed motor 2 is controlled by a sheet feed control section 3, so that the recording sheet 100 is conveyed in the subsidiary scanning direction (direction Y) by the rotation of the platen roller 1.

A pair of ink jet heads 4, 4 of the same shape and mass are arranged in the subsidiary scanning direction in parallel with each other while an interval is formed between the two ink jet heads 4, 4, and the pair of ink jet heads 4, 4 are directed to a surface of the recording sheet 100. In FIG. 2, which is a plan view, the two ink jet heads 4, 4 are stacked, one above the other. Therefore, one of the ink jet heads is cannot be seen in the drawing. Both ends of each ink jet head 4 are supported by a base 7 through support members 6, 6 made of metallic leaf springs.

The base 7 are rotatably supported by the frame through support shafts 8 provided on both sides of the bases 7. However, the base 7 are fixed by lock mechanisms not shown in the drawing so that the ink jet heads 4, 4 can be directed to the platen roller 1 when the ink jet heads 4, 4 conduct the printing operation. Each support member 6 is composed in such a manner that the width (thickness) "e" of the support member 6 in a direction parallel with the axis of the platen roller 1 is small so that the support member 6 can be easily subjected to elastic deformation and moved. Due to the elastic deformation of each support member 6, each ink jet head 4 can be subjected to primary scanning in the primary scanning direction (direction X) which is parallel with the axis of the platen roller 1 and perpendicular to the subsidiary scanning direction.

A large number of nozzles 9 are arranged in a line in the primary scanning direction on a face of each ink jet head 4 opposed to the recording sheet 100, so that drops of ink can be jetted out from the nozzles 9 to a surface of the recording sheet 100. The ink jetting operation is controlled by the ink jet control section 10. An ink tank 11 is provided for supplying ink to the ink jet heads 4, 4.

As illustrated in FIG. 1, permanent magnets 12, 12 are fixed to the ink jet heads 4, 4 in such a manner that the magnetic polarities are opposite to each other. An electromagnetic coil 13 for drive use is interposed between both permanent magnets 12, 12. An electric current supplied to the electromagnetic coil 13 is controlled by the reciprocal movement control section 14. The electromagnetic coil 13 is composed in such a manner that the multiple winding is formed into a doughnut-shape and fixed to the base 7 so that the winding can be interposed between the permanent magnets 12, 12.

FIG. 2 shows a state in which both the permanent magnet 12 and the electromagnetic coil 13 are located close to the center of the ink jet head 4 as compared with a state shown in FIG. 1. Either layout may be adopted in the present invention. Since the electromagnetic coil 13 is arranged being opposed to the permanent magnets 12, 12, when an electric current is allowed to flow in the electromagnetic coil 13, the permanent magnets 12, 12, which are not fixed, are driven in accordance with Fleming's left hand rule. Due to the foregoing, the ink jet heads 4, 4 are driven in the primary scanning direction while the support members 6 are elastically deformed. When an alternating current is allowed to flow in the electromagnetic coil 13, both ink jet heads 4, 4 are reciprocated in the primary scanning direction. When the distance of the movement of the ink jet head 4 is made to be substantially the same as the interval of the adjacent nozzles 9, ink jet recording can be conducted over the entire width of the recording sheet 100 even if the scanning width is small.

Such a reciprocating motion is controlled to be conducted to the elastic limit of the support members 6 which are elastic bodies. Accordingly, when the ink jet heads 4, 4 are reciprocated, energy is transferred back and forth between the elasticity of the support members 6 and the kinetic energy of the mass, so that the energy can be preserved. Therefore, even if a small amount of energy is supplied, the reciprocating motion can be driven. As a result, it is possible to remarkably reduce the electric power consumption of the electromagnetic coil 13. The most effective method to accomplish the above object is to make the frequency of the reciprocating motion coincide with the resonance frequency of mass of intake head and stiffness by support members 6 made of leaf springs.

Since the two permanent magnets 12,12 are arranged in such a manner that the magnetic polarities are opposite to each other, the two ink jet heads 4, 4 are always driven in opposite directions, with directly opposed phases. Due to the foregoing structure, the two ink jet heads 4, 4 of the same mass and the same vibrational characteristics, which are arranged in the subsidiary scanning direction, can be reciprocated in the primary scanning direction with directly opposite phases at all times. Accordingly, the reaction forces generated in both ink jet heads 4, 4 due to their reciprocal motions substantially cancel each other, so that the generation of high order vibration can be remarkably suppressed, and further added parts such as a counterweight are not required to keep the balance. Accordingly, drive energy is not wasted. In this connection, when not less than three ink jet heads 4 are provided, or alternatively when not less than two pairs of ink jet heads 4 are provided, the entire structure may be composed so that the reaction forces can be canceled as a whole.

As described above, when the two ink jet heads 4, 4 are reciprocated with opposite phases using one common electromagnetic coil 13, the structure can be made simple. Specifically, only one electromagnetic coil 13 is used, and further the drive circuit can be made very simple. Accordingly, the structure of the invention is very economical. On the surfaces of the ink jet heads 4, 4, there are provided scales 16, 16 (only one of them is shown in the drawing) for detecting the phases and amplitudes of the ink jet heads 4, 4 in the primary scanning direction. The scales 16, 16 are detected by the phase detection sensor 17 supported by the base 7. A detection signal output from the phase detection sensor 17 is sent to the reciprocal movement control section 14, and a drive current given to the electromagnetic coil 13 is controlled in response to the detected phase. The detection signal output from the phase detection sensor 17 is also sent to the ink jet control section 10, so that the ink jets sent out from the nozzles 9 are controlled in response to the phases of the ink jet heads 4, 4.

In this connection, the control operation of the ink jet control section 10 and the control operation of the reciprocal movement control section 14 are synchronized with each other by the image pattern generation timing control section 18 into which the printing signal is input. As described above, the linear motor composed of the electromagnetic coil 13 and the permanent magnets 12, 12 can have low drive force. A drive force given to each ink jet head 4 by the electromagnetic coil 13 may be lower than the force obtained when an amplitude of the reciprocal motion is multiplied by the rigidity of the support member 6. In this connection, the structure of the linear motor will be explained in detail later.

Figure 3:
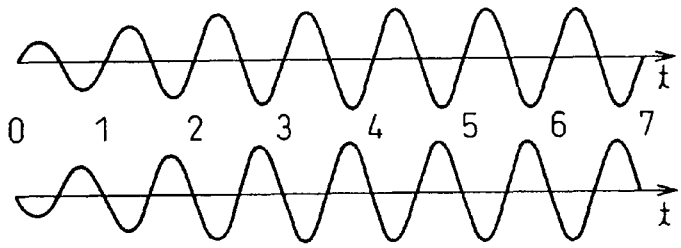
FIG. 3 is a characteristic diagram of vibration at the start of the printer of the first embodiment.

However, when the ink jet heads 4, 4 are started from a stationary condition, it is impossible to move them at a required amplitude in a single stroke. Therefore, as illustrated in FIG. 3 in which an example of the vibration (reciprocal motion) of each ink jet head 4 at the start is shown, after the ink jet head 4 has been reciprocated three times or more after starting the amplitude of the ink jet head may reach the predetermined value. During the period of starting of the ink jet head, other necessary starting operations are also carried out. In this connection, the number of the starting vibrations may be increased to 20, which causes no problems. When the permanent magnets 12,12 and the electromagnetic coil 13 are used for driving the ink jet heads 4, 4, the relation between the intensity of an electric current supplied to the electromagnetic coil 13 and the force generated by the action of the electric current becomes linear, so that the ink jet heads 4, 4 can be easily controlled and further they can be easily driven with opposite phases.

However, when two objects are moving under identical conditions, except for having opposite phases, it is impossible to drive the two moving objects with one electromagnetic coil 13 so as to have completely the same amplitude at opposite phases. In order to accurately control the two reciprocal motions with one electromagnetic coil 13, it is necessary that the force factor between the motions be slightly different, depending on the positions of the moving objects.

Figure 4:
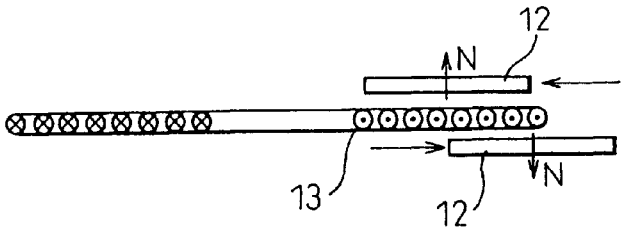
FIG. 4 is a partial front view of the drive section of the printer of the first embodiment.

Therefore, in this embodiment, as illustrated in FIG. 4, the areas of the magnetic field of the electromagnetic coil 13 crossed by the two permanent magnets 12, 12 are different and depend on the positions of the permanent magnets 12, 12. As a result, the force factors of the drive of the two ink jet heads 4, 4 conducted by one electromagnetic coil 13 are different from each other at the positions of the reciprocal motions of the ink jet heads 4, 4.

Figure 5:
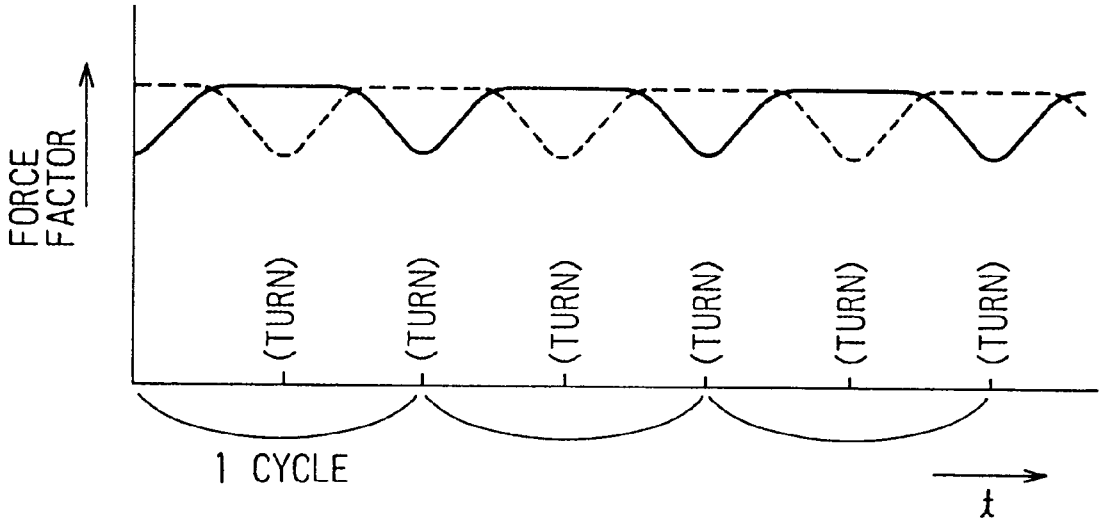
FIG. 5 is a characteristic diagram of the force factor of the drive section of the printer of the first embodiment.

In this case, assuming that the force factors of both ink jet heads 4, 4 are reduced when the ink jet heads 4, 4 are located at the left end of the reciprocal motion, as illustrated in FIG. 5, the phase of one of the ink jet heads indicated by a solid line, with its where the force factor being lowered, is shifted by 180° from the phase of the other of the ink jet heads indicated by a broken line.

As a result, the control of the reverse operation of the reciprocal motion is determined by the ink jet head 4 having a higher force factor which alternately moves to the right end, and the ink jet head 4 having a lower force factor which is located at the left end only follows the movement of the ink jet head located at the right end. Due to the foregoing control operation, both ink jet heads 4, 4 are reciprocated by one common electromagnetic coil 13 at the accurately uniform amplitude of the reverse phase.

When drops of ink are jetted out from the ink jet heads 4, 4, the recording sheet 100 is simply continuously fed, and the drops of ink are jetted out during the reciprocal motion caused by the back and forth movement of the ink jet heads 4, 4. When the foregoing operation is carried out, mechanical energy is seldom required for the reciprocal scanning motion, which is most economical. However, the locus of scanning described above becomes a sine curve on the surface of the recording sheet 100. Therefore, when drops of ink are jetted out at regular time intervals, the dot density increases at positions close to the turning point and decreases in the middle portion, that is, the dot density becomes uneven.

In order to solve the above problems, the following measures can be taken. For example, as shown in the second embodiment in FIG. 6, in response to the phases of the ink jet heads 4, 4 detected by the phase detection sensor 17, jets of the ink drops are stopped at a position close to the turning point by the control of the ink jet control section 10, so that only the central region, where the difference in dot density is small, is used for jetting ink drops onto the recording sheet. However, in this case, the idle time during which ink drops are not jetted out is increased. Therefore, the scanning efficiency of the ink jet head is reduced.

In order to solve the above problems, the following measures may be taken. For example, as shown in the third embodiment in FIG. 7, the amount of ink to be jetted is increased in the central region where the dot density is low, and the amount of ink to be jetted is decreased in the region close to the turning point where the dot density is high. In this case, the same control may be conducted with respect to a large number of nozzles 9 disposed in the width direction of the ink jet heads 4, 4. Therefore, this control can be easily carried out.

Figure 6:
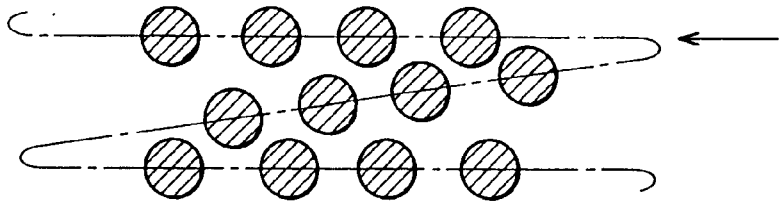
FIG. 6 is a schematic illustration showing a state of dots in the ink jet printer of the second embodiment of the present invention.
Figure 7:
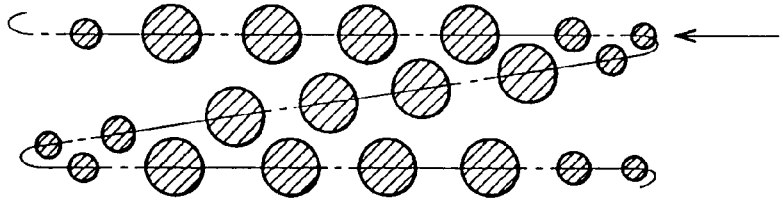
FIG. 7 is a schematic illustration showing a state of dots in the ink jet printer of the third embodiment of the present invention.

Also, the following measures may be taken. As illustrated in FIG. 7, ink jets are thinned out at a position close to the turning point at which the scanning speed is low, and drops of ink are jetted out at long time intervals. Further, as illustrated in FIGS. 6 and 7, the ink drop jetting position in the advancing stroke is made to be different from that of the returning stroke in the primary scanning direction. When drops of ink are jetted out under the above condition, the dot density on the recording sheet 100 can be made to be uniform even in the central region. However, while the printing operation is simply conducted under the condition that the locus of scanning is a sine curve on the recording sheet 100, the primary scanning direction does not become perpendicular to the subsidiary scanning direction on the recording sheet 100. Therefore, the calculation of ink drop jetting control becomes very complicated. It is possible to conduct such a complicated control processing when the processing speed of the arithmetic processing unit is increased. However, according to the apparatus to be used, a simple control processing is required in many cases. An embodiment to meet such a demand will be described as follows.

Figure 8:
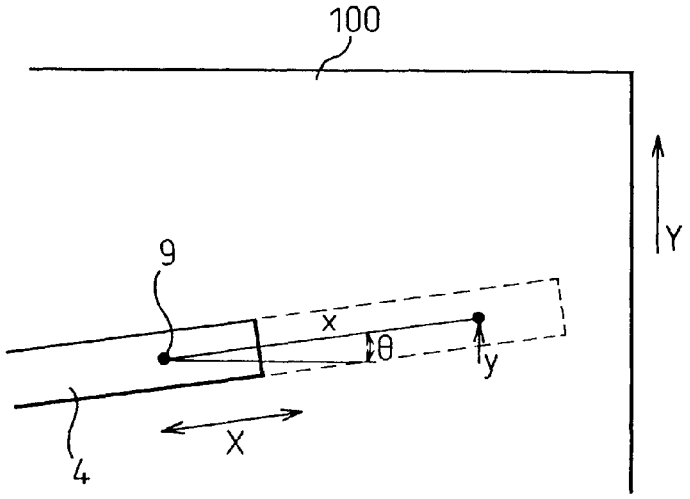
FIG. 8 is a partial front view of the drive section of the printer of the fourth embodiment.

FIG. 8 is a view showing the fourth embodiment. In this embodiment, the ink jet heads 4, 4 are inclined with respect to the platen roller 1 so that the primary scanning direction X can be inclined with respect to the subsidiary scanning direction Y which is the same as the sheet feed direction. As illustrated in FIG. 8, the inclination angle θ of the ink jet head 4 is determined so that the following expression can be satisfied, $$\sin\theta = y/x$$

where the scanning speed in the primary scanning direction is x, and the scanning speed in the subsidiary scanning direction is y.

Due to the foregoing, the scanning direction of the ink jet head 4 becomes approximately perpendicular to the subsidiary scanning direction on the surface of the recording sheet 100 that is moving in the subsidiary scanning direction. When drops of ink are jetted out only when the ink jet head is scanning in this direction, the primary and subsidiary scanning directions can be made to be perpendicular to each other on the recording sheet 100. Accordingly, it is not necessary to conduct a complicated conversion operation for the ink jet control.

Figure 9:
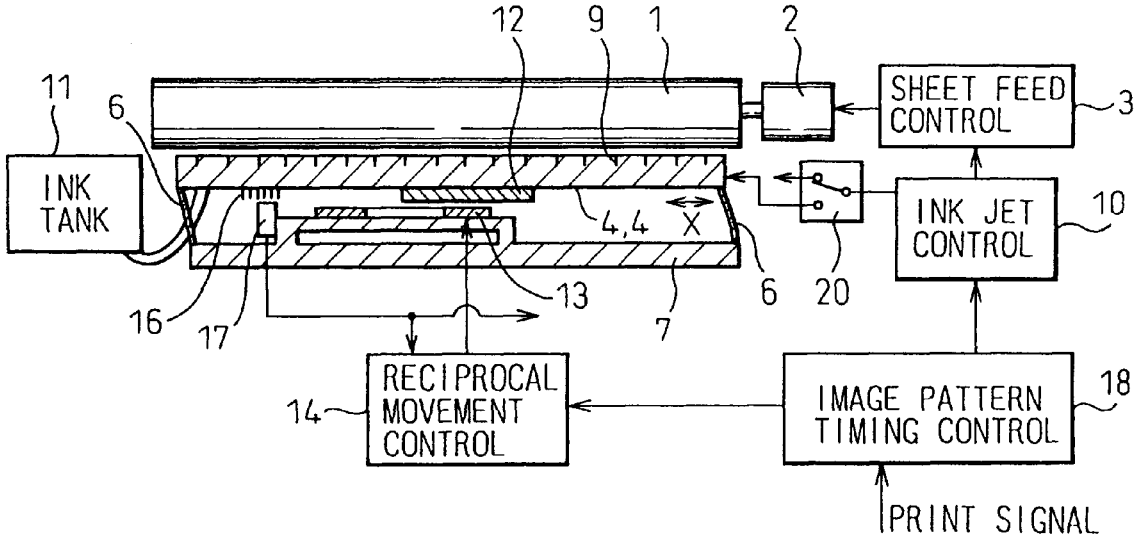
FIG. 9 is a plan view of the printer of the fourth embodiment.

In this case, no ink is jetted out in one direction of the reciprocal scanning. Therefore, half of the operation time is wasted, however, a certain period of time is required for fixing and drying the jetted ink, so that the time is not necessarily wasted. Each of the two ink jet heads 4, 4 reciprocated for scanning at the reverse phase may alternately jet out drops of ink only in the scanning in one direction. Accordingly, as illustrated in FIG. 9, a changeover switch 20 is provided between the ink jet control section 10 and the two ink jet heads 4, 4. The changeover switch 20 is changed over between the two ink jet heads 4, 4 for each scanning operation. In this way, one ink jet control section 10 can be used for both ink jet heads 4, 4.

Next, another measure will be described as follows. When the recording sheet is fed only at the turning points of the reciprocal scanning motion and stopped at the center of the reciprocal scanning motion, a complicated converting operation is not required for the ink jet control system. In this case, the shorter the scanning distance in the sheet feed direction is, the more the frequency of turning of the ink jet head is increased, and when the acceleration of the start and stop is the same, the total scanning time is increased.

The time t necessary for moving by the distance L/2 at a constant acceleration a is expressed by the following expression, $$L/2 = \alpha t^2/2.$$

From this expression, the expression $t=\sqrt{(L/\alpha)}$ is found, that is, the time t is proportional to the square root of the distance. Accordingly, the time required for moving by a distance l/n is proportional to $\sqrt{(l/n)}$. Therefore, when the movement is conducted n times, the total time is multiplied by $\sqrt{n}$. This is wasted time, during which printing is not carried out. Accordingly, it is preferable to reduced the waste time, for this reason, it is necessary to increase the acceleration α.

Therefore, it is necessary to take measures to reduce the energy required to feed the sheets. Since the inertial mass of the platen roller 1 for feeding sheets is much larger than that of the recording sheet 100, it is necessary to reduce the mass of the platen roller 1. In this connection, it is possible to apply a method by which the circumferential speed of the platen roller 1 can be varied while the angular momentum of the platen roller 1 is preserved. In figure skating, when a skater contracts his arms after the start of rotation, the rotational speed is increased.

Figure 10:
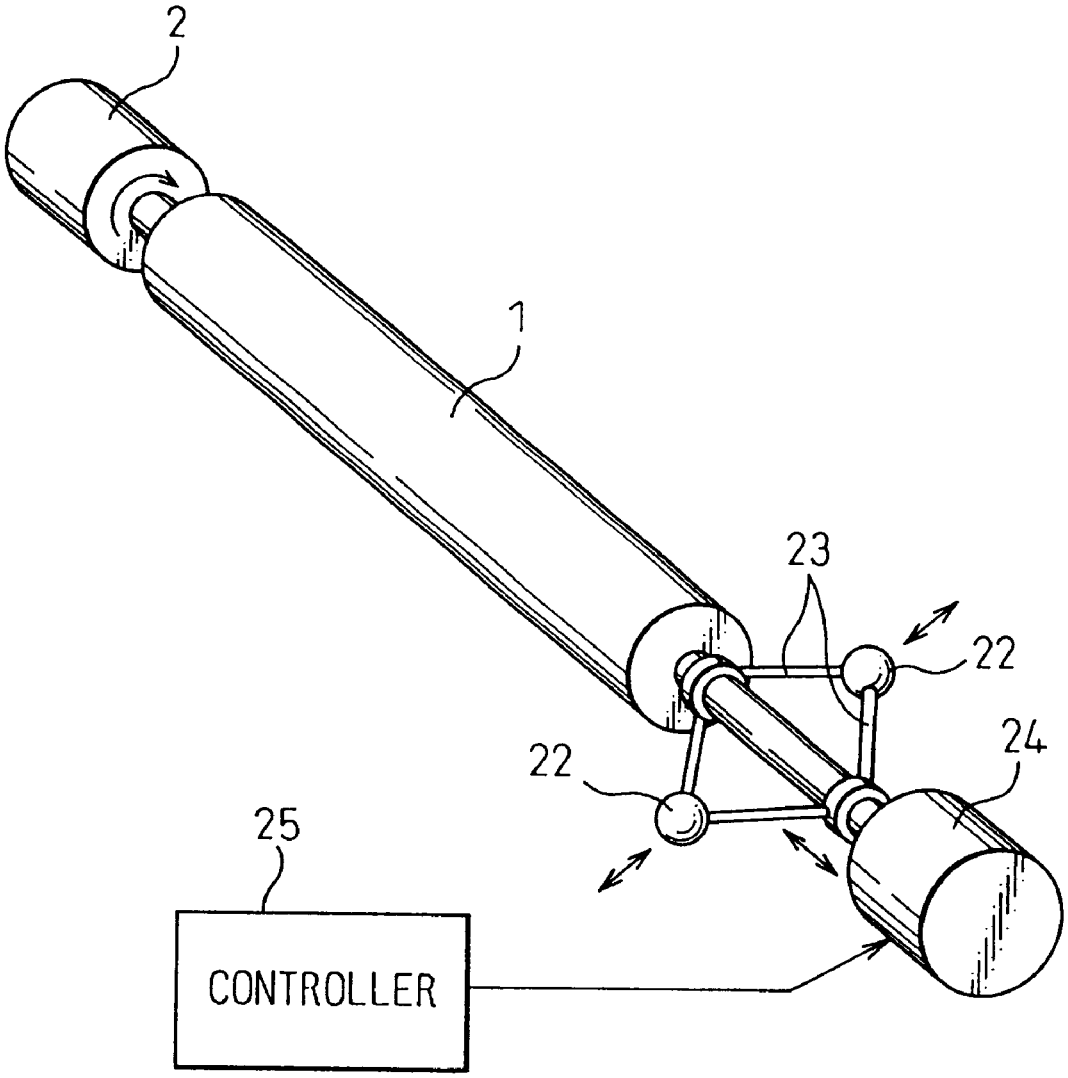
FIG. 10 is a partial perspective view of the printer of the fifth embodiment.

FIG. 10 is a view showing the fifth embodiment to which the above principle is applied. An additive weight 22 is attached to the end of a pantograph-shaped arm 23 for extension and contraction and rotated together with the platen roller 1. One end of the arm 23 for extension and contraction is pushed, for example, by a solenoid 24 in the axial direction of the platen roller 1. Due to the foregoing, a distance from the central axis of the platen roller 1 to the additive weight 22 can be changed.

In this case, the sheet feed motor 2 drives the platen roller 1 by a predetermined drive force. The control section 25 controls each unit as follows. In the central region of the reciprocal scanning in which drops of ink are jetted out, the additive weight 22 is made to be distant from the central axis of the platen roller 1 so that the rotational speed of the platen roller 1 can be reduced. At a position close to the turning point of the reciprocal scanning, the additive weight 22 is made to be close to the central axis of the platen roller 1 so that the platen roller 1 can be rotated at high speed so as to conduct sheet feeding.

Figure 11:
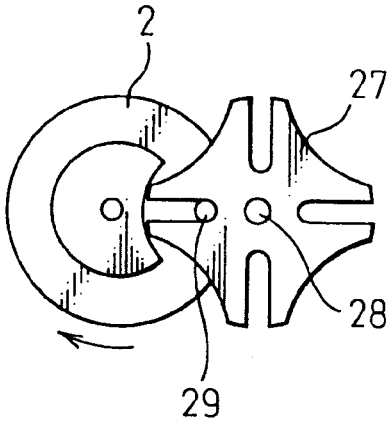
FIG. 11 is a partial side view of the printer of the sixth embodiment.

In order to drive the platen roller 1 simply intermittently, for example, as illustrated in the sixth embodiment in FIG. 11, a pin 29 protruding eccentrically with respect to the rotational shaft of the sheet feed motor 2 is engaged with a groove of a Geneva gear 27, and a shaft 28 of the Geneva gear 27 is directly connected to the platen roller 1. However, even in this intermittent motion, it is preferable that the kinetic energy is preserved while the sheet feed operation is stopped and the preserved energy is used when the unit is accelerated again for feeding sheets.

Figure 12:
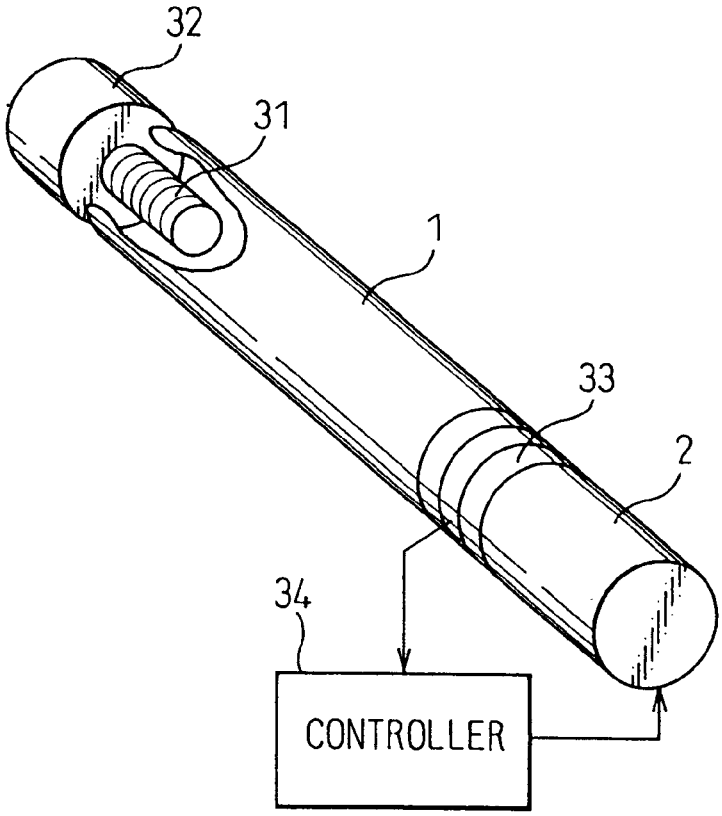
FIG. 12 is a partial perspective view of the printer of the seventh embodiment.

One of the methods is to use a resonance system composed of a spring and mass. As shown in the seventh embodiment illustrated in FIG. 12, the system is composed of a weight 32 concentrically connected to the platen roller 1 through an elastic coupling 31 such as a coil spring.

Since recording sheets must be fed with high accuracy, a rotational angle detector 33 is attached to the platen roller 1, and the detection signal is fed back to the control section 34, so that an intermittent driving motion is conducted by the sheet feed roller 2 with high accuracy. Due to the foregoing, the entire inertial mass can be preserved approximately constant in the sheet feed direction. Accordingly, the kinetic energy can be reduced to a low level, which is necessary for the adjustment of an error of the motion. Accordingly, when the sheet motion is started from a stationary state, it is not necessary to provide a high capacity drive force by which the unit is accelerated to a predetermined amplitude by one operation, but the acceleration may be conducted by several reciprocal operations so that the amplitude can be gradually extended.

Figure 13:
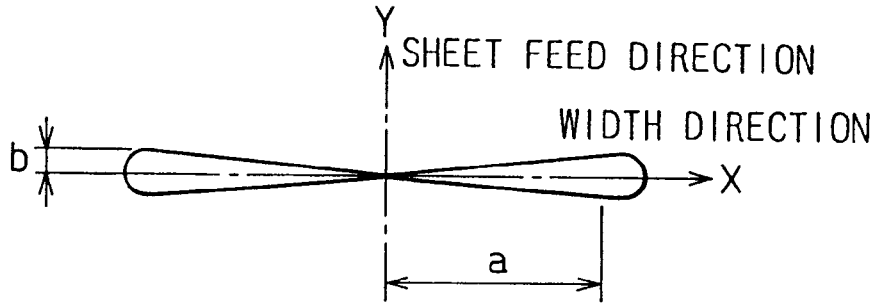
FIGS. 13 to 16 are scanning diagrams of the printer of the eighth embodiment of the present invention.
Figure 14:
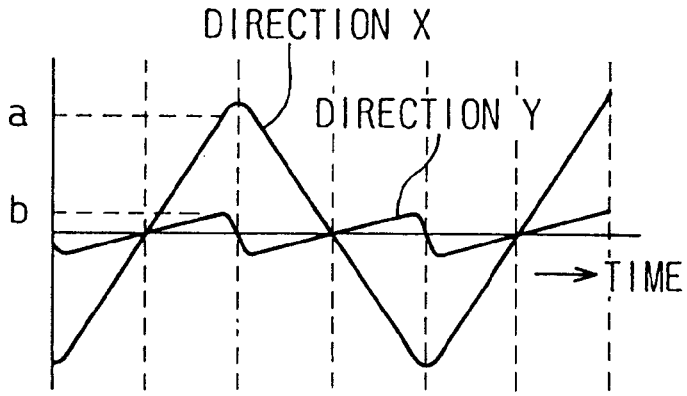

A method in which the energy is further reduced will be described below. The recording sheet 100 is fed at a constant speed, and the ink jet heads 4, 4 are subjected to a figure-8-shaped motion as illustrated in FIG. 13. In a region in which a speed (vector) of the above motion of the ink jet heads in the sheet feed direction becomes the same as the sheet feed speed, drops of ink are jetted out. Due to the foregoing, the primary and subsidiary scanning directions become perpendicular to each other on the recording sheet 100. In this way, it is possible to form images aligned in a line in the transverse direction on the recording sheet 100. In this case, the motions in the X and Y directions with respect to elapsed time are shown in FIG. 14. However, it the mass is simply supported by a spring, curved motions are made in all portions. Accordingly, it is impossible to obtain images which are aligned on the recording sheet.

In the case where a drive force is applied to correct a phase slippage caused between two vectors of the motions, the directions of which are perpendicular to each other, in order to obtain the control signal, it is necessary to provide a sensor to detect the position or speed. However, the detection of signals in the overall scanning region is not necessarily required. In some cases, it is sufficient that the signal is detected at the local maximum point of vibration or at the point of crossing the origin. That is, since the ink jet heads 4, 4 are supported by the springs, there is no indeterminate variables such as friction. Therefore, errors in synchronization can be sufficiently corrected by the integral correction described by control theory.

As explained above, such a correction is conducted while electric energy is being consumved. In order to further save energy, it is preferable that the predetermined motion is carried out while the energy of motion of the heads is preserved.

Figure 15:
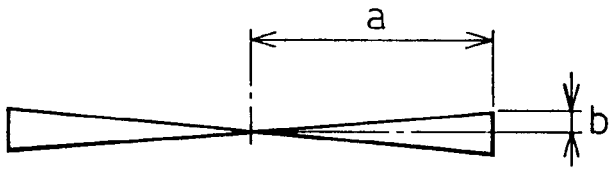

According to the Fourier transform theory, when controlled higher harmonics are superimposed, the figure-8-shaped motion can be made more linear as illustrated in FIG. 15. Concerning the higher order vibration components necessary for such motion, energy is converted from the kinetic energy into elastic energy and then converted from the elastic energy into the kinetic energy. Therefore, it is sufficient that only an amount of energy corresponding to the loss be supplied, so that the drive can be carried out with high efficiency. In the actual structure, a heavy loss is caused in the higher order components, and further undesirable components of the motion such as twist are caused. Accordingly, it is necessary that the point at which the drive force is applied be made to coincide with the center of gravity so as to prevent the generation of twisting components. Also, it is necessary that the rigidity of the support spring be sufficiently high so as to resist the twisting component.

Figure 16:
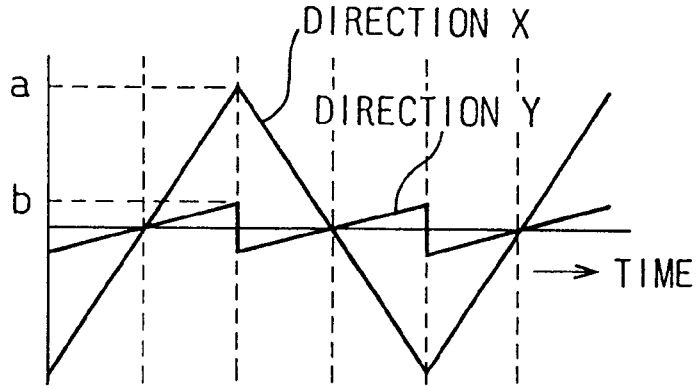

In this case, the motions in the X and Y directions with respect to the lapse of time are expressed by triangular waves as shown in FIG. 16. These triangular waves are transformed into the following Fourier series:

$$\frac{2}{\pi}\sum_{n=1}^{\infty}\frac{\cos(2m-1)}{(2m-1)^2}$$

As can be seen from the above expression, the Fourier series of the triangular waves contains high order frequency components. In this case, the first order components can be provided by a resonance system composed of a spring and mass, and the second and third components can be provided by an electrical circuit when it is put into practical use. In this case, L and C may be connected to the electrical circuit so that recycled. As described above, the fundamental frequency of the vertical vibration is twice as high as that of the transverse vibration. Since the resonance frequency $(m/k)^{1/2}$ is determined by the mass m and rigidity k, and the inertial mass is same value to both motions, it is preferable to set the rigidity k of the support member 6 four times higher in the vertical direction than in the transverse direction. When the width of the support member is e and the thickness is t, since its rigidity is proportional to $et^3$ and the ratio of the rigidity in the vertical direction to the rigidity in the transverse direction should be 4, the following expressions are set up.

$$et^3=4te^3$$

$$t^2=4e^2$$

$$t=2e$$

Figure 17:
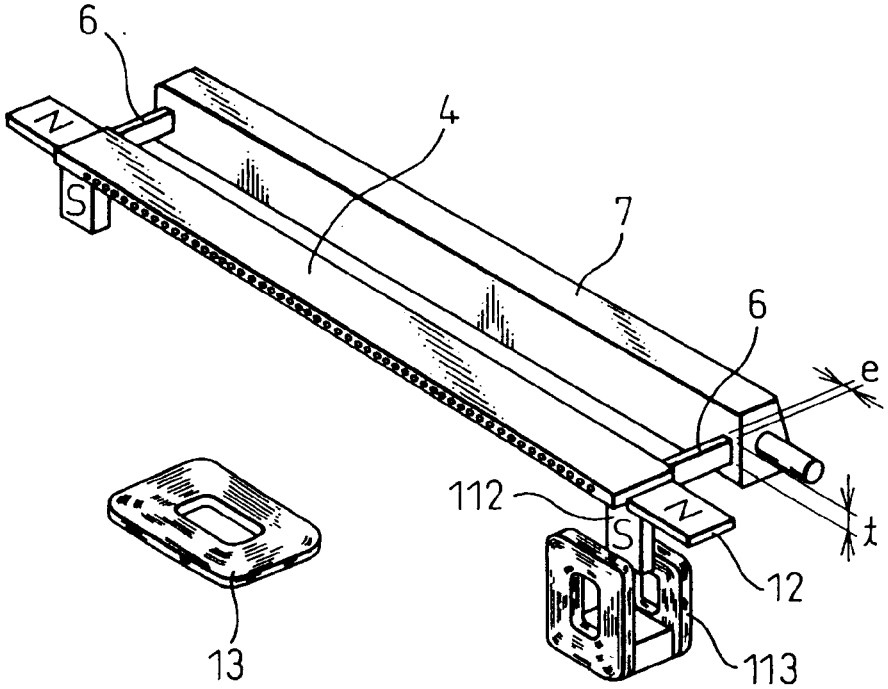
FIG. 17 is a partial perspective view of the printer of the eighth embodiment.

FIG. 17 is a view showing a printer of the eighth embodiment in which the ink jet heads 4, 4 are subjected to the numeral-8-shaped scanning operation described above. In this embodiment, in addition to the permanent magnet 12 attached horizontally in the same manner as that of the first embodiment, a permanent magnet 112 is vertically attached to the ink jet head 4. In order to drive the permanent magnet 112, there is provided an electromagnetic coil 113 separately from the electromagnetic coil 13 used for horizontal driving. In this embodiment, a pair of ink jet heads 4 are provided in parallel with each other, however, one of them is omitted in the drawing. As described above, when higher harmonic components, the frequencies of which are as high as the multiples of integers of the fundamental frequencies, are superimposed, a portion of the superimposition is conducted by a resonance frequency. Due to the foregoing, the control circuit consumes energy only for correction, so that the efficiency can be enhanced.

Figure 18:
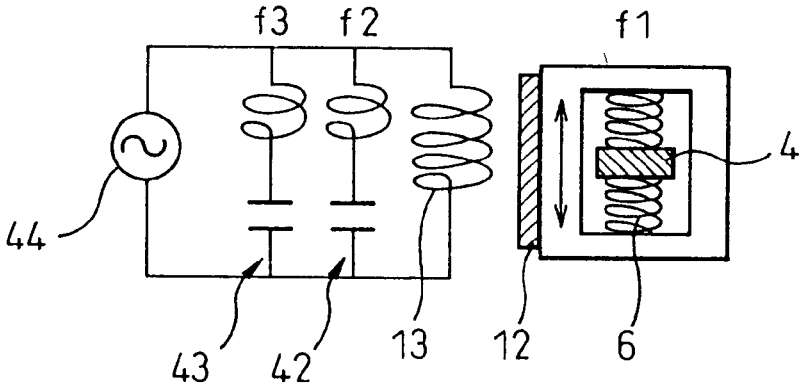
FIG. 18 is a schematic illustration of the drive unit of the printer of the eighth embodiment of the present invention.

FIG. 18 is a view showing a model of the electric circuit used for superimposing such higher harmonics. In FIG. 18, there are provided two lines of LC circuits 42, 43 for producing the second and third order vibration frequencies f2 and f3 with respect to the first order vibration frequency f1, to the electromagnetic coil 13. The LC circuits 42, 43 are connected to the electromagnetic coil 13 in parallel. Reference numeral 44 is an alternating power source. In this connection, there are provided two resonance systems, one is a resonance system of the electric circuit composed of the inductance of coil (C) and the capacitance (L), and the other is a mechanical resonance system composed of a spring and mass incorporated into a movement mechanism. Due to the interaction, it is possible to express both resonance systems by the equivalent electric circuits.

It is possible to allot the mechanical and electrical resonance systems respectively to the first and second order vibration frequencies. According to modern control theory, when the vibration model is provided inside the system, the aforementioned control having multiple degree of freedom can be realized. Therefore, it is possible to realize the control system described above.

In the ink jet printer, there is a problem that the nozzles are stopped up when the ink becomes dry. In order to solve the above problem, in a common ink jet printer, the ink jet head is withdrawn to a position outside the sheet width in the primary scanning direction, and a nozzle wiping device and a nozzle cover are arranged at the withdrawal position. However, since the ink jet head is withdrawn to the position outside the recording sheet width in the primary scanning direction, the width of the apparatus must be twice as wide as the width of the recording sheet. Accordingly, in the ink jet printer of each embodiment in which the ink jet nozzles are disposed in the primary scanning direction, the dimensions of the apparatus are greatly increased.

Figure 19:
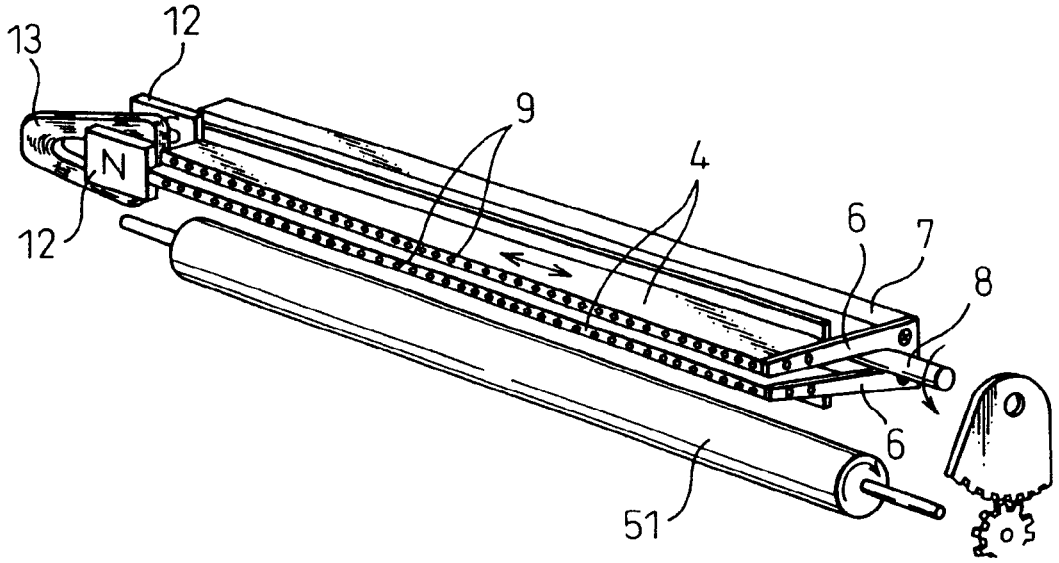
FIG. 19 is a partial perspective view of the printer of the ninth embodiment.

In order to solve the above problems, in the ninth embodiment shown in FIG. 19, the ink jet heads 4, 4 are rotated around the shaft 8 to a withdrawal position located in the subsidiary scanning direction not opposed to the recording sheet 100. During the withdrawal motion, an ink jet face on which the nozzles 9 are arranged is made to contact with a wiper roller 51 so that the nozzles 9 can be wiped clean. Due to the foregoing, an increase in the size of the apparatus can be prevented.

Although not shown in the drawing, a nozzle cover for covering the nozzle arrangement face of nozzles 9 of the ink jet head 4 may be provided so as to protect the nozzle arrangement face. Further, a nozzle protecting and maintaining means may be provided. It is preferable to arrange an ink drop jetting inspection mechanism in the withdrawal direction.

Figure 20:
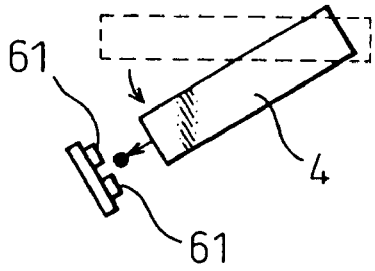
FIG. 20 is a partial side view of the printer of the tenth embodiment.

FIG. 20 is a view showing the tenth embodiment in which such an ink drop jetting inspection mechanism is provided. In this embodiment, drops of ink are jetted out from the ink jet head 4 to a pair of parallel electrodes 61, 61, and the existence of drops of ink can be detected by a change in the capacitance caused by the existence of ink or alternatively by a change in the electric resistance when ink is a conductive liquid. Although the dielectric constant of ink changes in accordance with the frequency, it is several to 80 times as high as the dielectric constant of air. Consequently, when drops of ink are jetted out to the parallel electrodes 61, 61, the capacitance is increased. Therefore, it is possible to detect a change in the capacitance using an electric circuit. Drops of ink are jetted out from each nozzle, and it is detected whether or not the capacitance is increased. Due to the foregoing, the occurrence of the stop page of nozzles can be detected.

Figure 21:
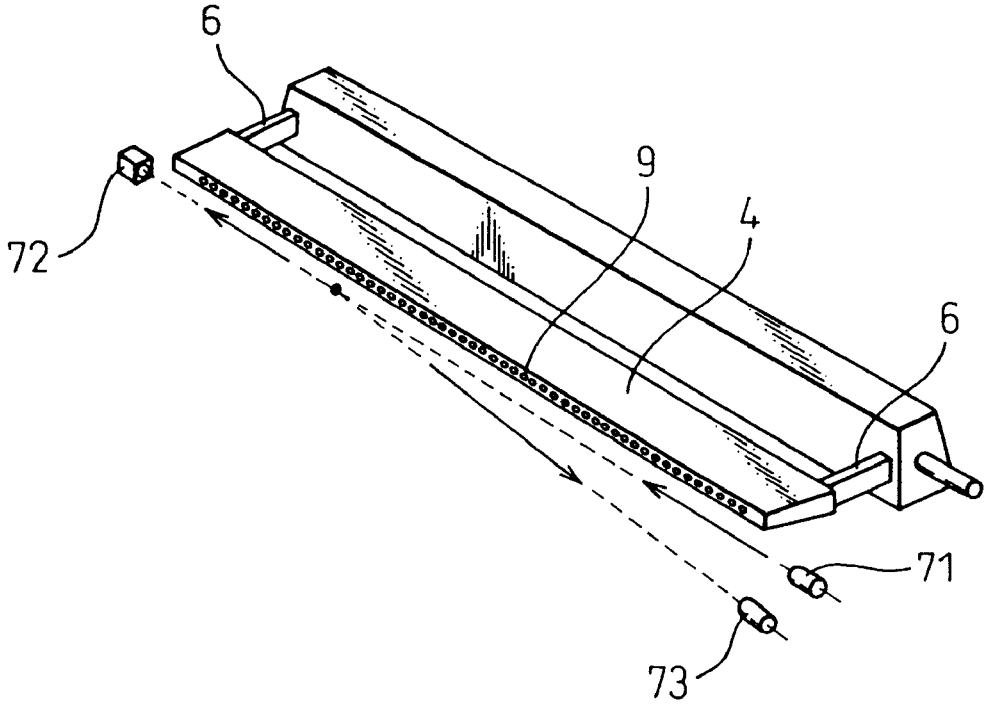
FIG. 21 is a partial perspective view of the printer of the eleventh embodiment.

In the eleventh embodiment illustrated in FIG. 21, there are provided a light emitting element 71 and optical detectors 72, 73 at positions close to both ends of the ink jet head 4, and interception of light by the drops of ink is detected while the drops of ink are successively jetted out from each nozzle 9. Due to the foregoing, the stop page of nozzles can be detected, by a means is simpler than the electrode system described before. In this case, fine beams such as laser beams are appropriate to the light emitting beams. Interception of light by drops of ink may be detected by the optical detector 72 disposed being opposed to the light emitting element 71, or alternatively diffusion of light caused by drops of ink may be detected by the optical detector 73 disposed on the side of the light emitting element 71.

Figure 22:
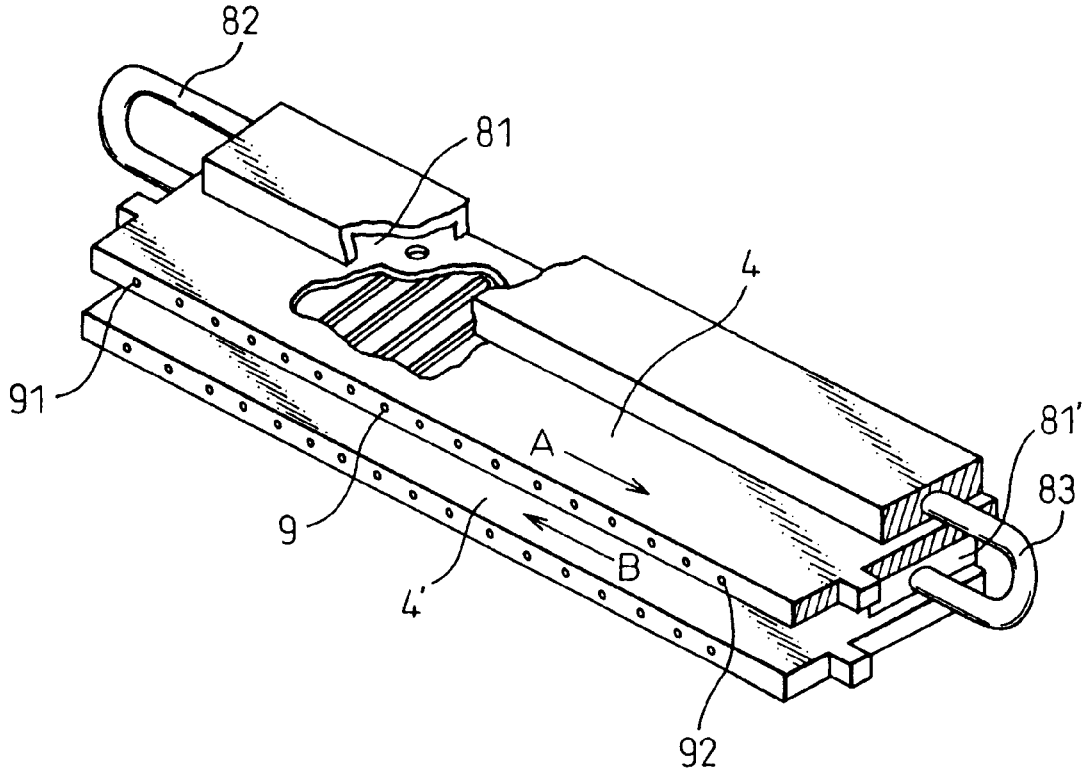
FIG. 22 is a partial perspective view of the printer of the twelfth embodiment.

FIG. 22 is a view showing the twelfth embodiment of the present invention. When the two ink jet heads 4, 4', which are disposed in parallel with each other in the subsidiary scanning direction while leaving a clearance between them, are reciprocated in the opposite direction to each other, in the case where the movements of the ink jet heads 4, 4' are reversed, the pressure values of ink accommodated in the ink reservoirs 81, 81' are not balanced with respect to the nozzle 91 at one end of the head and the nozzle 92 at the other end of the nozzle due to the inertia of ink itself. Therefore, for example, when the movement of the ink jet head 4 is reversed in the direction of arrow A, the pressure of ink at the nozzle 91 is increased. Therefore, drops of ink are unnecessarily jetted out from the nozzle 91. Also, the pressure of ink at the nozzle 92 on the opposite side of the same ink jet head 4 is decreased. Therefore, even when jetting ink is required, ink can not be jetted out due to the lack of pressure.

In order to solve the above problems, the end portions of the ink reservoirs 81, 81' of the ink jet heads 4, 4' are connected to each other by ink bypass passages 82, 83 made of flexible tubes, wherein the end portions of the ink reservoirs 81, 81' adjacent to each other are connected here. Due to the foregoing structure, when the movements of the ink jet heads 4, 4' are reversed, ink flows from an end of one of the ink reservoirs 81, 81', the ink pressure of which is increased, to an end of the other of the ink reservoirs 81, 81', the ink pressure of which is decreased, through the ink bypass passages 82, 83. In this way, it is possible to prevent the fluctuation of ink pressure in the ink reservoir in the reversal of movements of the ink jet heads 4, 4'. Consequently, drops of ink can be positively jetted out in the predetermined manner.

Figure 23:
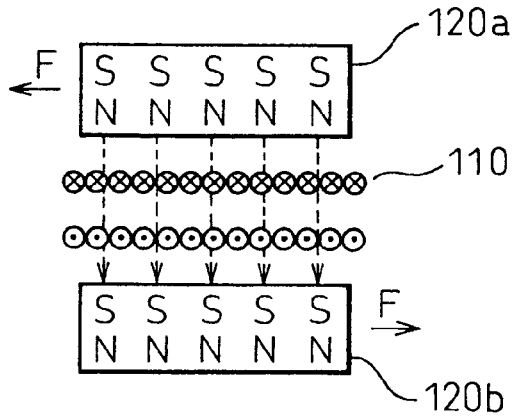
FIG. 23 is a schematic illustration showing the principle of the linear actuator used in the present invention.

FIG. 23 is a schematic illustration showing the principle of an actuator preferably used for driving the ink jet head of the ink jet printer of the present invention. Specifically, this actuator includes: a stationary coil 110, and two permanent magnets 120*a*, 120*b*, at least one of which is movable, and the unlike magnetic poles of which interpose the stationary coil 110, so that magnetic fields can be formed in a direction perpendicular to the axial direction of the stationary coil 110.

When an electric current is allowed to flow in the stationary coil 110, a force F is generated by this electric current and the two permanent magnets 120*a*, 120*b*. The permanent magnets 120*a*, 120*b* are moved in the opposite direction to each other by the force F of which the directions are opposite to each other. Consequently, a force transmitted from the permanent magnets 120*a* to the stationally coil is canceled. Therefore, it is possible to prevent the generation of vibration.

Figure 24:
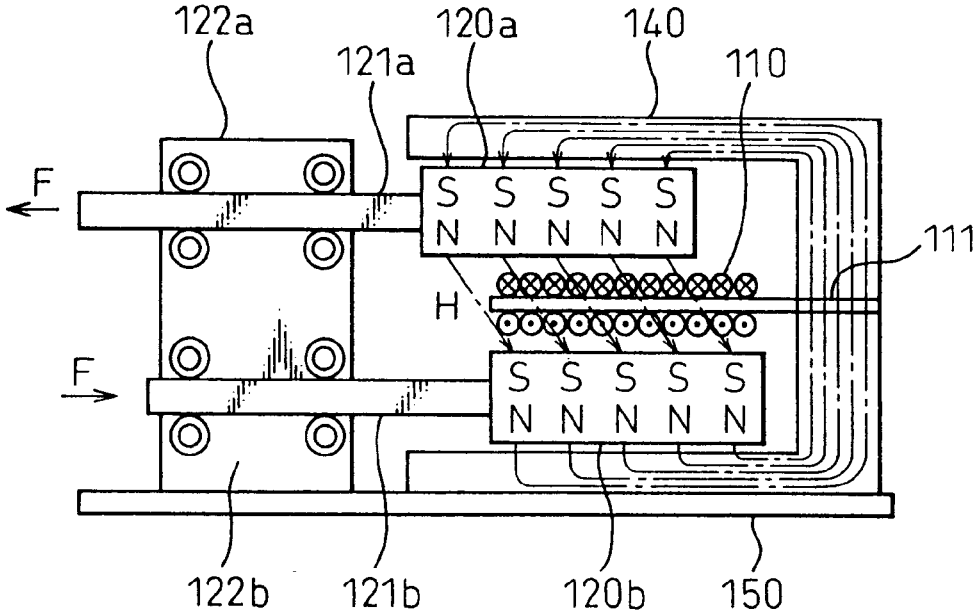
FIG. 24 is an arrangement view of the embodiment of the linear actuator.

FIG. 24 is a cross-sectional side view of the embodiment of an actuator capable of being used for the present invention. At the center of the actuator, there is provided a stationary coil 110 wound around a magnetic core 111 having a high magnetic permeability. On both sides of the stationary coil 110, there are provided two movable permanent magnets 120*a*, 120*b* while a predetermined clearance is maintained between the stationary coil 110 and the movable permanent magnets 120*a*, 120*b*. These two movable permanent magnets 120*a*, 120*b* are disposed in such a manner that opposite magnetic poles are opposed to each other. Accordingly, a magnetic field H is formed in the direction perpendicular to the axial direction of the stationary coil 110. In this case, only the direction of the magnetic flux formed by the movable permanent magnets 120*a*, 120*b* does not flow in the axial direction of the magnetic core 111 of the stationary coil 110. Accordingly, it is not necessary to provide the cross-sectional area of the magnetic core ill, sufficient to pass the whole flux of permanent magnets, so that the dimensions of the apparatus can be reduced.

The ends of the two movable permanent magnets 120*a*, 120*b* in the longitudinal direction are connected with guide bars 121*a*, 121*b*. The guide bars 121*a*, 121*b* are supported by linear guides 122*a*, 122*b* which are support members for supporting the movable permanent magnets 120*a*, 120*b* by the base 150. Due to the foregoing structure, it is possible for the two movable permanent magnets 120*a*, 120*b* to move in the longitudinal direction in parallel with each other. In this connection, in the linear guides 122*a*, 122*b*, the guide bars 121*a*, 121*b* are interposed between two pairs of upper and lower bearings.

There is provided a C-shaped magnetic core 140 made of material of a high magnetic permeability in such a manner that the outsides of the two movable permanent magnets 120*a*, 120*b* are connected by the magnetic core 140, wherein predetermined clearances are formed between the outsides of the movable permanent magnets 120*a*, 120*b* and the insides of the magnetic core 140. Due to the foregoing, the magnetic field can be effectively generated between the stationary coil 110 and the insides of the movable permanent magnets 120*a*, 120*b*.

When an electric current is allowed to flow in the stationary coil 110 in the above structure, the movable permanent magnets 120*a*, 120*b* are subjected to force F in the opposite directions.

Figure 25:
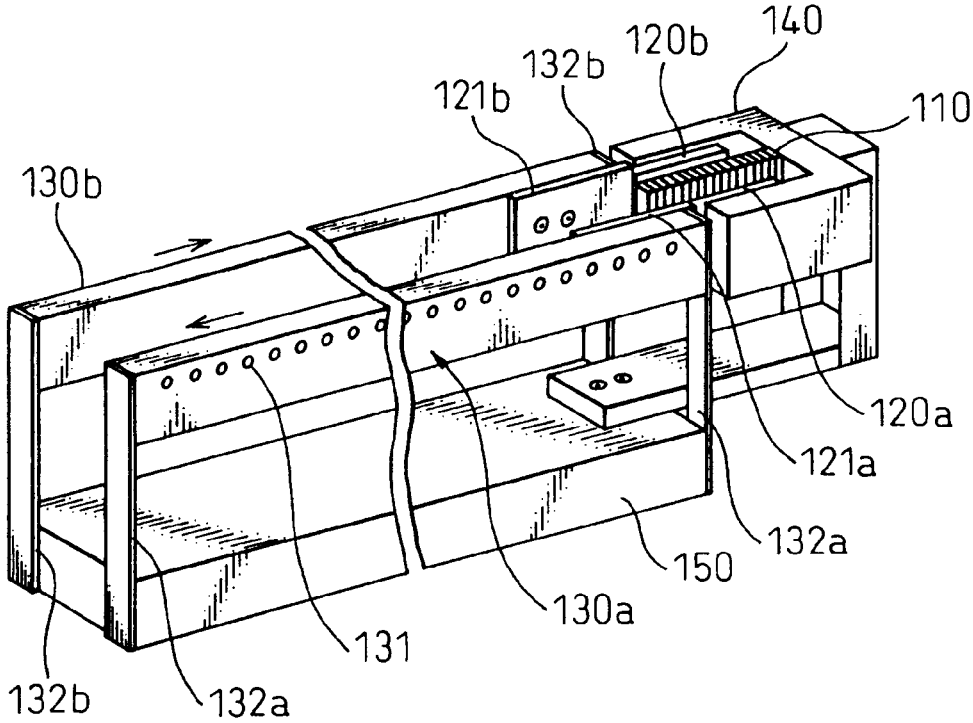
FIG. 25 is a perspective view of the embodiment of the ink jet printer head to which the linear actuator is applied.

FIG. 25 is an arrangement view showing a case in which the thus composed actuator is applied to the head of the ink jet printer described above. As illustrated in FIG. 25, the guide bar 121*a* of the movable permanent magnet 120*a*, which is one of the above movable permanent magnets 120*a*, 120*b*, is connected to an end of the printing head 130*a* in which a large number of ink jet nozzles 131 are disposed, and further both ends of the printing head 130*a* are supported by the base 150 through the leaf springs (elastic members) 132*a*. The guide bar 121*b* of the movable permanent magnet 120*b*, which is the other of the above movable permanent magnets 120*a*, 120*b*, is connected to an end of the dummy printing head 130*b* having no ink jet nozzles, and the other end of the dummy printing head 130*b* is supported by the base 150 through the leaf springs (elastic members) 132*b* in the same manner as described above.

When an electric current is allowed to flow in the stationary coil 110 in the predetermined direction, one movable permanent magnet 120*a* and the printing head 130*a* are moved in the predetermined direction (for example, to the left in the drawing), resisting the forces of the leaf springs 132*a*, and the other movable permanent magnet 120*b* and the printing head 130*b* are moved in the opposite direction (for example, to the right in the drawing), resisting the forces of the springs 132*b*. When a sine wave current is given to the stationary coil 110, the printing head 130*a* and the dummy printing head 130*b* are moved and the vibration causing force imported to the base 150 are opposite and cancel each other.

In the above-mentioned embodiment, even under the condition that the dummy printing head 130*b* is supported by the base 150, substantially the same effects can be provided. The above explanations are made with respect to the case in which the present invention is applied to a printing head. However, it should be noted that the present invention is not limited to a case of the printing head but the present invention can be applied to a case in which a specific sensor needs to be moved back and forth and the resulting vibration has a bad effect on the base.

What is claimed is:

1. An ink jet printer comprising:

a printer main body;

a recording medium conveyance means for conveying a recording medium in a subsidiary scanning direction;

a plurality of ink jet heads, each having a plurality of nozzles jetting drops of ink to a surface of the recording medium, the ink jet heads being capable of moving in a primary scanning direction which is substantially perpendicular to the subsidiary scanning direction, the ink jet heads being arranged in the printer main body and being aligned in the subsidiary scanning direction, and each of the plurality of ink jet heads is driven in opposite directions from one another; and a head reciprocation drive means for driving the ink jet heads in the primary scanning direction at phases different to each other, wherein the plurality of ink jet heads includes at least one pair of ink jet heads provided and driven by the head reciprocation drive means at precisely opposite phases, the head reciprocation drive means including:

a permanent magnet directly attached to each of the at least one pair of ink jet heads, and an electromagnetic coil generating a drive force for driving, arranged in a stationary portion of the printer main body in such a manner that the electromagnetic coil is opposed to both permanent magnets, wherein the permanent magnets are disposed so that a magnetic field of one of the permanent magnets and a magnetic field of the other of the permanent magnets can act on the electromagnetic coil in opposite directions, wherein a support member for supporting each of the ink jet heads, on a stationary member of the printer main body is made of an elastic member, and reciprocation of each of the ink jet heads is carried out within a limit of elasticity while the support member is elastically deformed, and wherein each ink jet head is supported by the elastic support member so that it can be moved not only in the primary scanning direction but also in the subsidiary scanning direction, and each ink jet head is driven in the subsidiary scanning direction as well as the primary scanning direction in accordance with a moving speed of the recording medium in the subsidiary scanning direction.

* * * * *